US006854200B2

(12) United States Patent
Hipp et al.

(10) Patent No.: US 6,854,200 B2
(45) Date of Patent: Feb. 15, 2005

(54) SKATE SHIELDS

(75) Inventors: Carl D. Hipp, West Chester, PA (US); James M. McCrossin, Sicklerville, NJ (US); Thomas K. McCrossin, Boothwyn, PA (US)

(73) Assignee: JCT Innovations, LLC, Sicklerville, NJ (US)

( * ) Notice: Subject to any disclaimer, the term of this patent is extended or adjusted under 35 U.S.C. 154(b) by 124 days.

(21) Appl. No.: 10/384,074

(22) Filed: Mar. 7, 2003

(65) Prior Publication Data

US 2003/0196351 A1 Oct. 23, 2003

Related U.S. Application Data

(60) Provisional application No. 60/362,798, filed on Mar. 7, 2002.

(51) Int. Cl.[7] ..... A43B 7/14; A43B 5/04; A43B 5/16; A63C 11/00

(52) U.S. Cl. ..... 36/96; 36/72 R; 36/115; 36/136; 280/811

(58) Field of Search ..... 36/96, 115, 132, 36/136, 131, 72 R; 280/811, 11.12, 11.13

(56) References Cited

U.S. PATENT DOCUMENTS

| | | | | | |
|---|---|---|---|---|---|
| 2,029,787 | A | * | 2/1936 | Ohler | 280/811 |
| 2,267,253 | A | | 12/1941 | Ream | |
| D157,124 | S | | 2/1950 | Boughey | |
| 2,829,449 | A | | 4/1958 | Edwards et al. | |
| 2,984,917 | A | * | 5/1961 | Saunders | 280/811 |
| 3,102,347 | A | | 9/1963 | Griswold et al. | |
| 3,271,888 | A | * | 9/1966 | Graham et al. | 36/72 R |
| 4,231,170 | A | | 11/1980 | Griswold | |
| 4,351,537 | A | * | 9/1982 | Seidel | 280/11.12 |
| 5,234,230 | A | * | 8/1993 | Crane et al. | 280/811 |
| 5,313,719 | A | | 5/1994 | Koethe | |
| 5,566,476 | A | * | 10/1996 | Bertrand et al. | 36/72 R |
| 5,711,092 | A | | 1/1998 | Despres et al. | |
| 5,829,170 | A | * | 11/1998 | Lutz, Jr. | 36/72 R |
| D418,967 | S | | 1/2000 | Stengel | |
| 6,170,174 | B1 | | 1/2001 | Gesso | |

* cited by examiner

*Primary Examiner*—Anthony Stashick
(74) *Attorney, Agent, or Firm*—Akin Gump Strauss Hauer & Feld, LLP

(57) ABSTRACT

Skate shields have a resiliently flexible protective shell with an upper portion curved so as to cover a medial side of the boot from near the toe to the instep and at least from the sole plate on the inner (medial) side of the boot over the boot to the outer (lateral) side of the boot. The protective shells are asymmetrically shaped, their continuity being broken in a location away from the medial side. The lower, inner medial edge of the upper shell is curved to contact and follow the medial side edge of the sole plate while a tongue extends transversely under the sole plate to hook the shield along the sole plate medial edge. The front end rests on the reinforced toe of the skate.

25 Claims, 17 Drawing Sheets

SKATE SHIELDS

CROSS-REFERENCE TO RELATED APPLICATIONS

This application claims the benefit of U.S. Provisional Patent Application No. 60/362,798, filed Mar. 7, 2002, entitled "Skate Protector", which is incorporated by reference herein in its entirety.

BACKGROUND OF THE INVENTION

The invention relates to protective devices and, in particular, to protective shields for hockey type skates.

BRIEF SUMMARY OF THE INVENTION

Briefly, the invention is a skate shield improvement in a skate having a toe end, a heel end and medial and lateral sides extending between the toe and heel ends. The skate includes a skate portion and a boot fixedly attached to the skate portion through a sole plate. The skate portion has a bottom side spaced from the sole plate and designed to contact a surface supporting the skate. The boot includes at least a foot portion extending between toe and heel ends of the skate and a shaft opening proximal the heel end of the skate to receive skater's foot. The skate shield improvement comprises a protective shell which is mounted to the skate and which includes at least an upper shell portion extending upwardly at least past the medial side of the sole plate, up the medial side and over an upper side of the foot portion of the boot in front of the shaft opening, and at least partially over a lateral side of the boot to a lateral free end. Continuity of the protective shell is broken at the free lateral end. The protective shell is sufficiently resiliently flexible and secured sufficiently solidly with one or more rigid areas of the skate on the medial side of the skate to transfer energy from impacts against the medial side of the upper shell to the one or more rigid portions of the skate on the medial side of the skate and away from flexible portions of the boot on the medial side of the skate covered by the protective shell.

In another aspect the invention is a shield for a skate having a skate portion and a boot mounted on the skate portion through a sole plate, the skate including a toe end, a heel end and medial and lateral sides, the sole plate facing and attached to a top side of the skate portion and supporting a foot portion of the boot shaped to cover a person's foot between the toe and heel ends, a space being provided between the skate portion and the sole plate, the shield comprising: a protective shell including an upper shell portion and a tongue, the upper shell portion being generally curved so as to fit over the boot of the skate from proximal the toe end at least to an instep area of the boot and at least from a medial side edge of the sole plate on the medial side of the skate to an opposing, lateral side of the skate, the tongue extending transversely from a bottom edge of the medial side of the upper shell beneath the sole plate sufficiently to hook the shield on the sole plate along the medial side of the sole plate, the shield further being asymmetric with continuity of the shield being broken between a free lateral end of the upper shell portion and a free lateral end of the tongue, the shell being sized and shaped to contact and extended along a medial side edge of the sole plate and the shell being of a construction sufficiently resiliently flexible to deflect impact against the medial side of the shield at least to the medial side of the sole plate.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
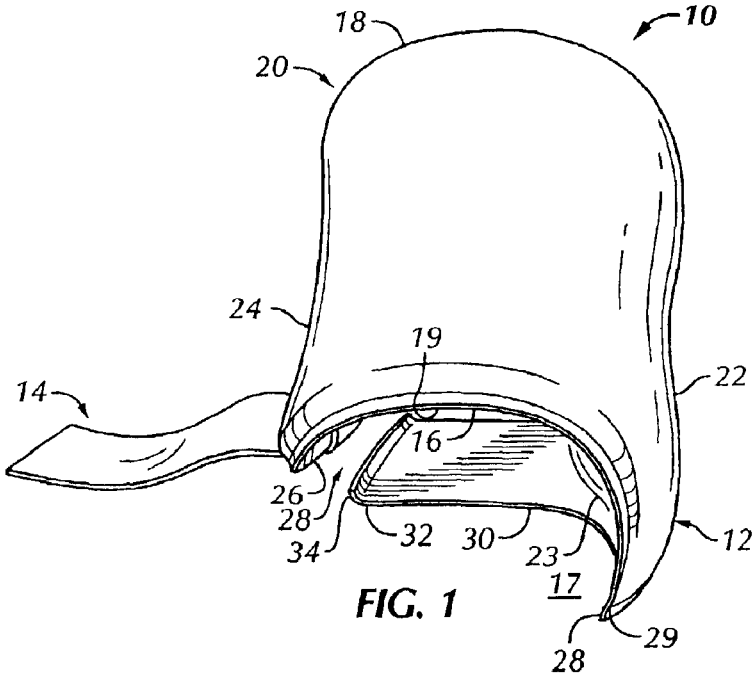
FIG. 1 is a view of the front of a first embodiment skate shield of the present invention before mounting on a skate.

Skate shields of the present invention are used on skates. A first embodiment, exemplary skate shield of the present invention is indicated generally at 10 in FIGS. 1–9 and is generally representative in that it comprises a protective shell indicated generally at 12. Shield 10 further includes strapping in the form of a single strap indicated generally at 14 but other embodiments may use another means of added securement or omit added securement altogether. The shield 10 is used with a skate for hockey, an ice hockey skate in particular being indicated generally at 40 in FIGS. 5–9 but in-line roller skates used for street hockey can also employ shields of the present invention.

The shield 10 and other shields of the present invention are designed and engineered to protect osseous and soft tissue structures of the foot and ankle, particularly on the "medial" (i.e. inner) side and top of the foot, which are particularly vulnerable to traumatic injury in the sport of hockey. The most frequent mechanisms of injury/trauma are either incidental impact of the medial foot/ankle by a puck traveling at a high velocity and unseen by a player or deliberate impact as a player attempts to block or redirect a traveling puck. The effort may be admirable; however, resulting fractures and soft tissue injuries frequently take these players out of the line up. The device also provides protection to the top of the foot which can be struck with the stick. The goal of the device is to prevent or minimize the effects of such medial foot/ankle impact injuries. The specific physiological structures protected, to the extent they are physically covered by the device, are as follows:

osseous (bony) structures including: talus (head); cuboid; lateral cuneioform; middle/intermediate cuneioform; medial cuneioform; navicular (navicular tuberosity); shaft of the $1^{st}$ metatarsal; head of the $1^{st}$ metatarsal; base of the $1^{st}$ metatarsal; shaft of the $2^{nd}$ metatarsal; shaft of the $3^{rd}$ metatarsal; shaft of the $4^{th}$ metatarsal; base of the $5^{th}$ metatarsal; shaft of the $5^{th}$ metatarsal; and sesmoid bones in flexor hallucis brevis tendons;

ligaments including: deltoid ligament (tibionavicular; anterior talotibial; calcaneotibial; and posterior tibial;

muscles/tendons including: peroneus brevis; peroneus tertius; peroneus longus; tibialis anterior; fourth, third, second and first dorsal interossei; abductor hallucis; extensor hallucis brevis; extensor hallucis longus; extensor digitorum longus; and extensor digitorum brevis; and other underlying structures including: articulating cartilage; retinaculum; synovium; and local nerve and blood supply.

The skate 40 of FIGS. 5–9 includes a rigid skate portion indicated generally at 42, a sole plate indicated generally at 54 and a boot 50. The skate 40 and each of the skate portion 42, sole plate 54 and boot 50 includes a toe end 51 and a heel end 52 and inner ("medial") and outer ("lateral") sides 57, 58 extending between the ends. The skate 40 and skate portion 42 have a common bottom side 44 with a blade 45 designed to contact a surface supporting the skate 40, and an opposing top side indicated generally at 46. The top side 46 is provided by the upper ends of front and rear stanchions 47, 48, respectively, holding and extending upwardly from the blade 45. The stanchions 47, 48 provide a gap 49 beneath an instep area 53 of the boot 50. The boot 50 is fixedly attached to the skate portion 42 through sole plate 54, which faces and is attached to the upper ends of the stanchions 47, 48. The boot 50 includes a foot portion 55 extending above the sole plate 54,which is shaped generally to cover a person's foot between the toe and heel ends 51, 52. The boot 50 further includes a "shaft" with opening 59, which is the portion of the boot at the heel end that rises above the top of the foot portion 55 at about the instep area 53 of the boot and which is configured to extend partially up and surround at least the ankle of the skater's leg. In a conventional ice hockey skate, the sole plate 54 is rigid, often a hard leather or steel but can be a hard plastic or a combination of these materials while the boot 50 is softer leather, canvas and/or synthetic material more flexible that the sole plate. A reinforced (e.g. steel) toe member 51' and reinforced heel member 52' are also usually provided in the boot 50 of the hockey skate 40 for player protection. The reinforced toe and heel members 51', 52' together with the skate portion 42 and sole plate 54 are considered rigid parts or areas of the skate 10 in comparison to the rest of the boot 50. Depending upon the mode of construction, the sole plate 54 may be made part of the skate portion 42 and the boot 50 attached thereto or made part of the boot 50 and attached to the skate portion 42. The sole plate 54 is generally constitutes the interface between the rigid part of the skate, the skate portion 42, and the more flexible part of the skate 10, the boot 50.

The protective shell 12 of the skate shield 10 has a front or "toe" end indicated generally at 16 in many of the figures with a toe opening 17 and an opposite rear or "instep" end indicated generally at 18 with a larger, rear opening 19. The shell 12 is preferably one integral molded piece of uniform material composition that includes an upper shell portion indicated generally at 20 and a tongue portion indicated generally at 30. The upper shell portion 20 is curved in multiple directions into a general saddle shape so as to fit generally over and around the boot 40 from proximal the toe end 51 to the instep area 53 of the boot 50 in front of the shaft 59. More particularly, upper shell portion 20 wraps over and around the boot extending at least up past the inner/medial side of the sole plate 54, up the medial side 57 and over an upper side 56 of the foot portion 55 of the boot 50 from proximal the toe end 51 to proximal the instep area 54 and shaft 59, preferably to lateral free end 26 spaced from but preferably at least proximal to the sole plate 54 on the opposing, outer/lateral side 58 of the boot 50. In device 10, tongue 30 extends transversely from one side, the inner/medial side 22 of the upper shell 20 under the sole plate 54. In particular, the tongue 30 is joined with the upper shell portion 20 at the bottom of the inner/medial side 22 of the upper shell portion 20 along a joint or intersection indicated generally at 23 in FIGS. 1–5. The tongue 30 also has a free lateral end 32 extending transversely away from the one (inner/medial) side 22 and the intersection 23 and generally toward the lateral free end 26 of the upper shell portion 20 and outer/lateral side of skate 40. A gap or split or space 27 is provided between the free ends 26, 32 to break the continuity of the shell 12 and permit it to be slipped on and off the toe end 51 of the boot 50 of the skate 40.

Figure 5:
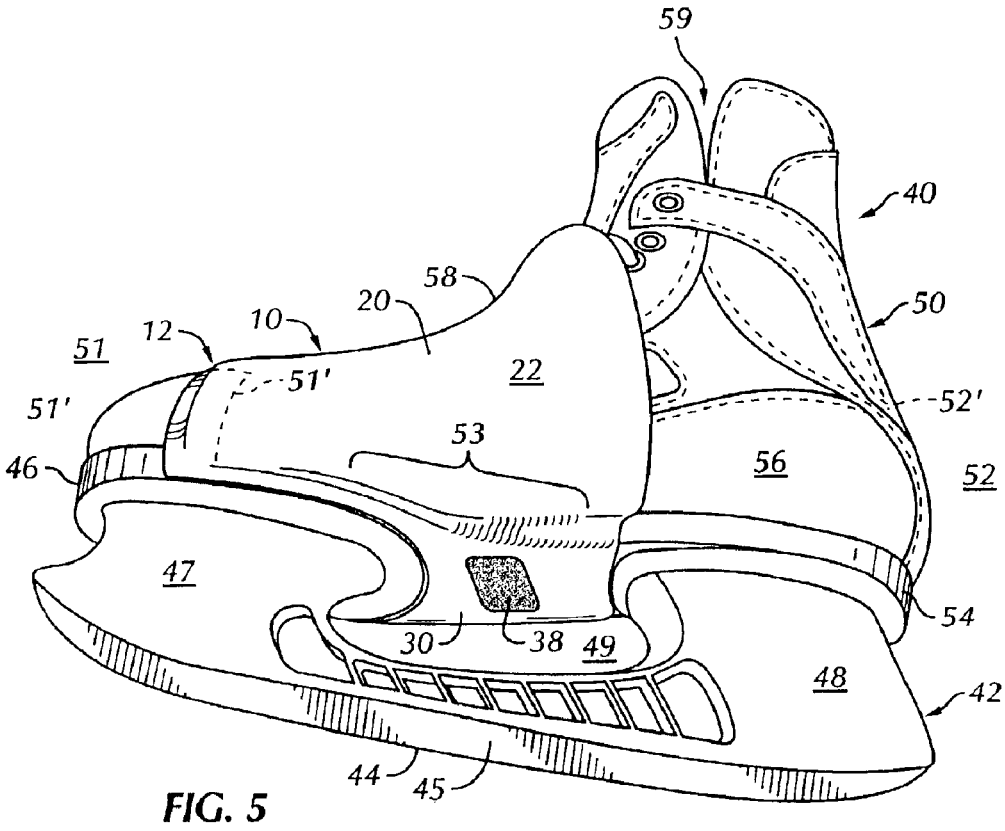
FIG. 5 is a front lower view of the left side of the skate shield of the previous figures being mounted to a skate.
Figure 7:
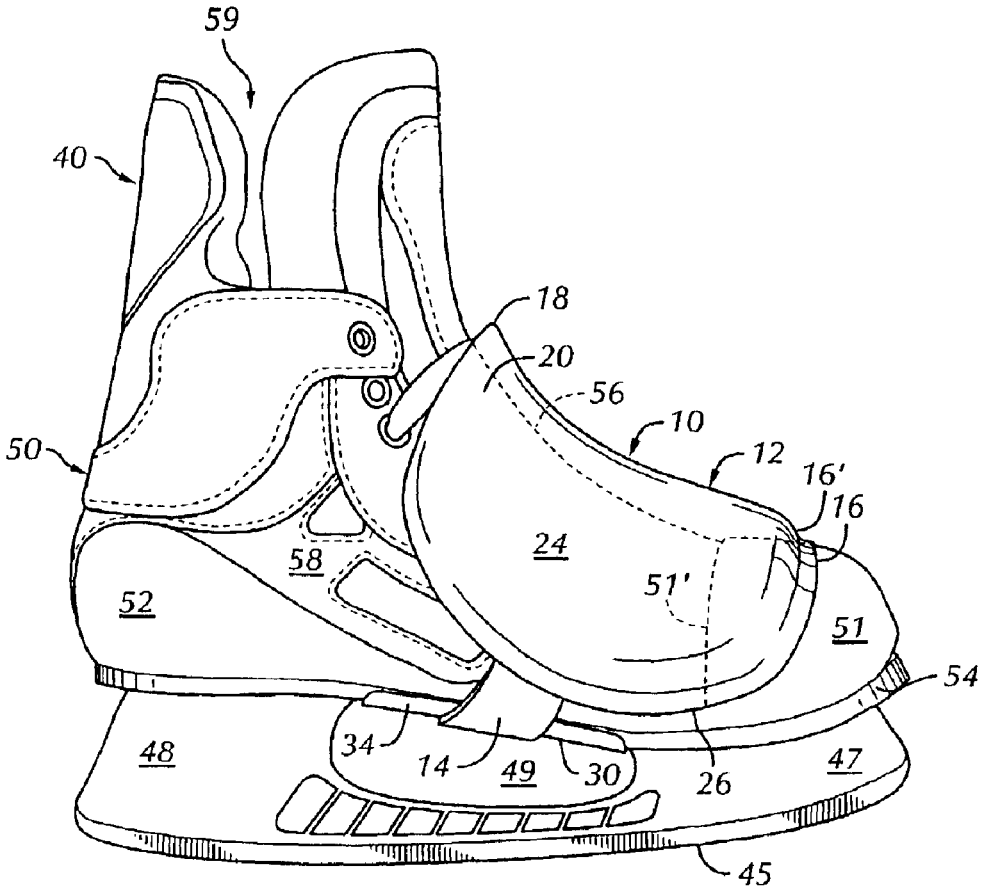
FIG. 7 is a view of the right side of the shield mounted to the skate.
Figure 8:
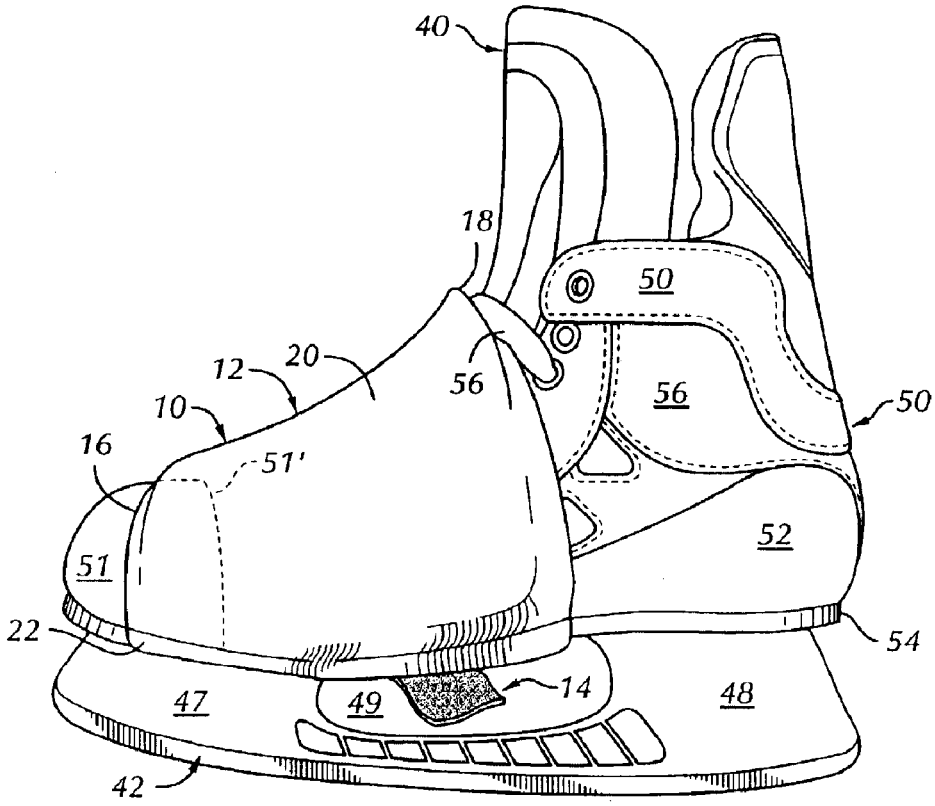
FIG. 8 is a view of the left side of the shield mounted to the skate.
Figure 9:
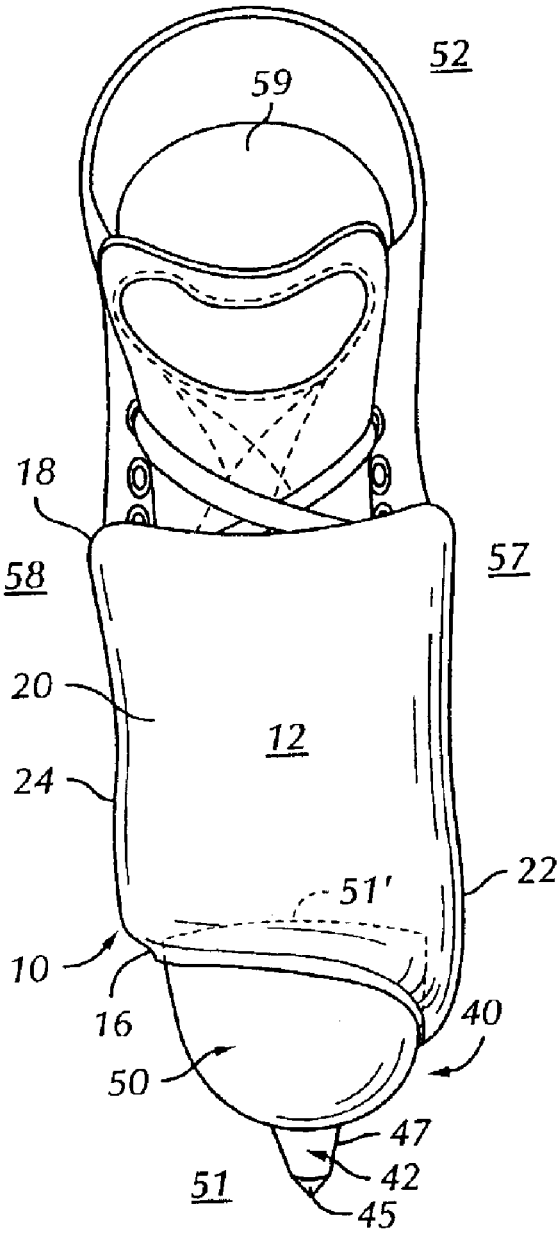
FIG. 9 is a top view of the shield mounted to the skate.
Figure 10:
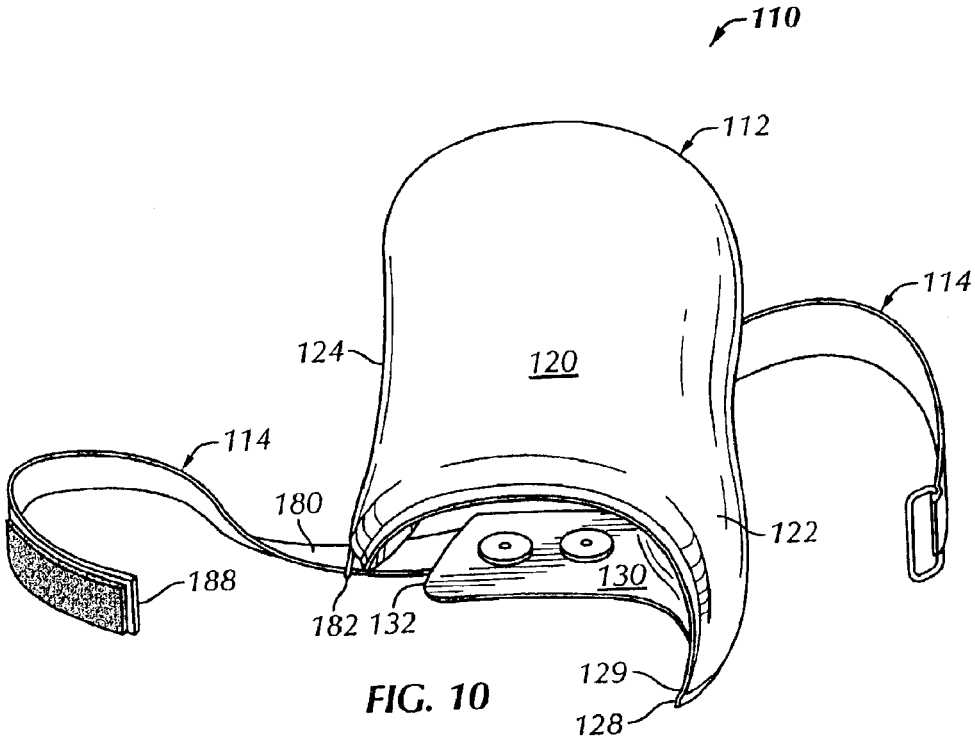
FIG. 10 is a view of the front of a second embodiment skate shield of the present invention before mounting on a skate.
Figure 11:
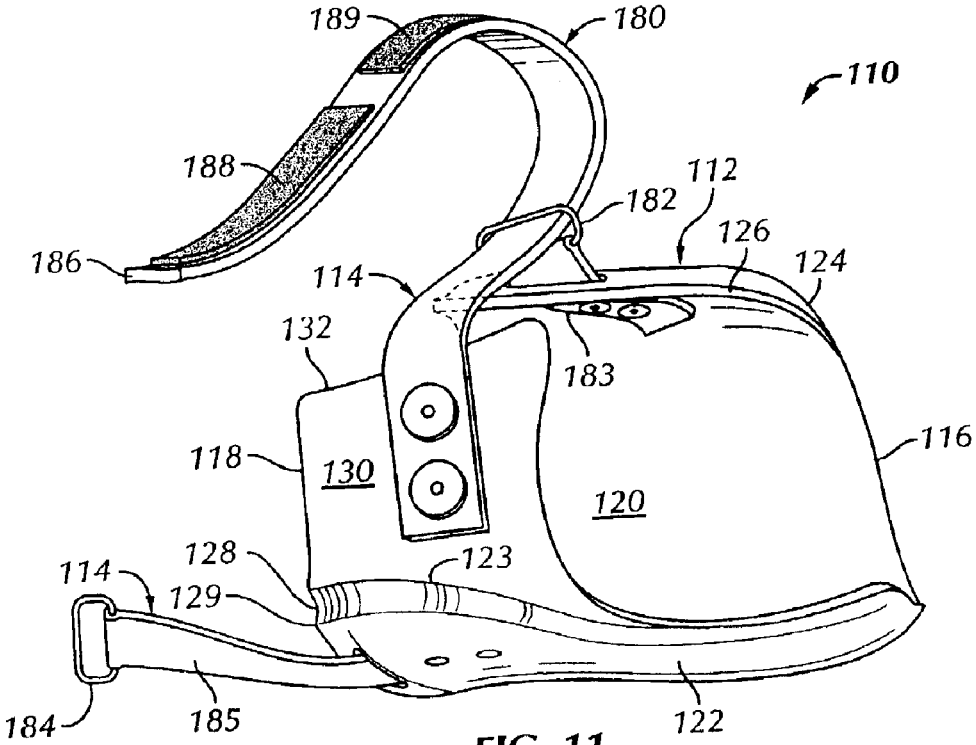
FIG. 11 is a view of the bottom of the skate shield of FIG. 10.
Figure 12:
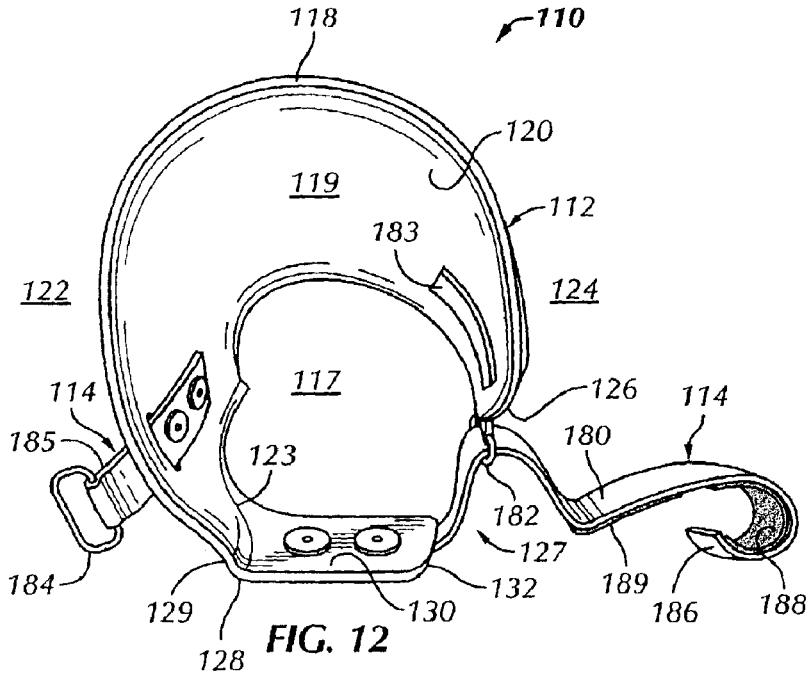
FIG. 12 is a view of the rear of the skate shield of FIG. 10.
Figure 13:
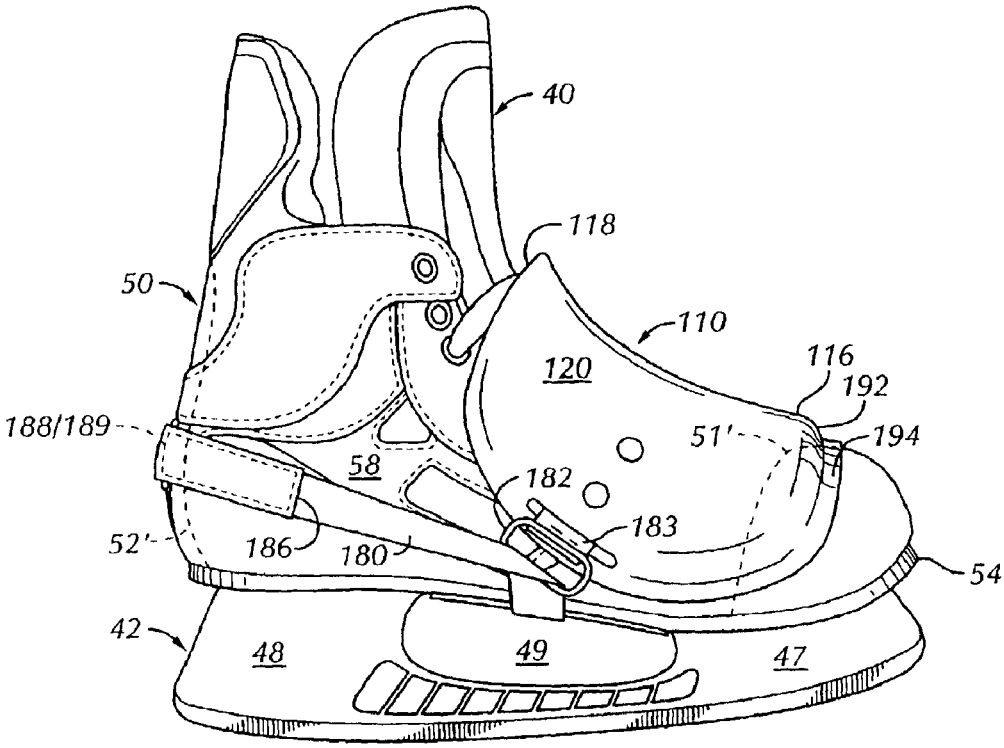
FIG. 13 is a view of the right side of the shield of FIG. 10 mounted to a skate.
Figure 14:
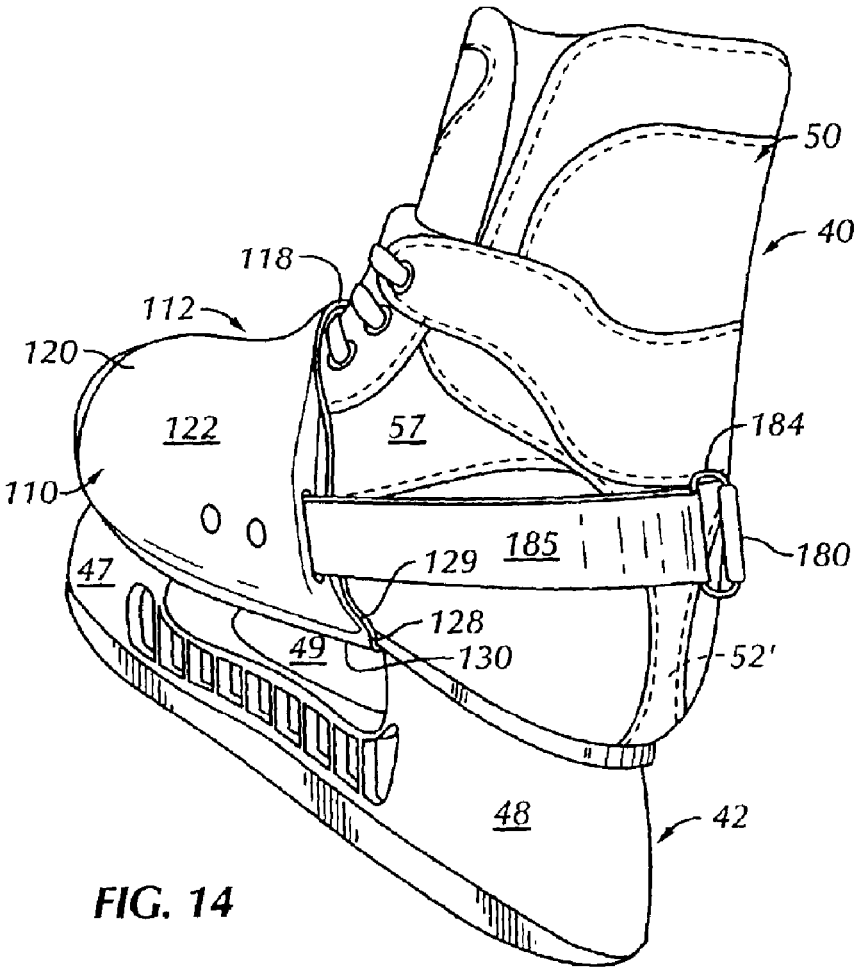
FIG. 14 is a rear view of the left side of the skate and shield of FIG. 13.

The upper shell portion 20 preferably is sized and shaped so as to extend at least down to the inner/medial side of the sole plate 54 sufficiently to hook the shield 10 on at least one side, the inner/medial side e.g. 57 of the sole plate 54 as is best seen in FIG. 5. Shields of the present invention are secured solidly with at least one or more rigid areas of the skate 10 on the inner/medial side 57 of the skate to transfer energy from impacts against the medial side 57 of the upper shell 20 to one or more rigid areas of the skate 40 on the medial side of the skate 40 and away from the flexible portion of the boot 50 behind the reinforced toe 51' which is covered by the protective shell 12. More particularly, joint 23 between the tongue 30 and upper shell portion 20 of shield 10 is preferably configured to mate solidly with and, in particular, is curved to follow and contact the inner/medial side of the sole plate 54 along the length of the shell 12 or at least at enough points along the side of the sole plate 54 to provide the functions to be describe on the inner/medial side 57 of the boot 50. To that goal, the lower periphery of the upper shell portion 20 at joint 23 includes a flange 28 sized and shaped to abut, contact and follow the inner/medial side of sole plate 54. A shoulder 29 is provided in the upper shell portion 20 extending generally upwardly away from the flange 28 and joint 23 and outwardly from the joint 23 and flange 28 so that the upper shell portion 20 flairs somewhat radially outwardly away from the inner/medial side 57, top 56 and outer/lateral side 58 of the boot above the sole plate 54 so as to be spaced away from the more flexible/softer areas of the boot 50 behind the reinforced toe 51'. At the same time, the upper shell portion 20 preferably curves generally radially inwardly in defining the opening 17 at the toe end 16 of the shell 12 and is configured by thickening, ribbing, etc. to provide a stiffer, forwardmost edge 16' abutting against the reinforced toe 51' with the rest of the upper shell portion 20 extending rearward over the boot 50, spaced from the upper side 56 and medial and lateral sides 57, 58 of the boot 50. This is best seen in FIGS. 7–9. The shell 12 of device 10 preferably only contacts rigid portions of the skate 40, primarily the sole plate 54 but also the reinforced toe 51', so that energy from impacts against the medial side of the shell 12 of shield 10 is resiliently transmitted from the shield 10 to the skate 40 and, more particularly, is at least substantially if not essentially transferred by the shell 12 to rigid areas of the skate 40, namely the side of the sole plate 54 and reinforced toe 51'.

Figure 6:
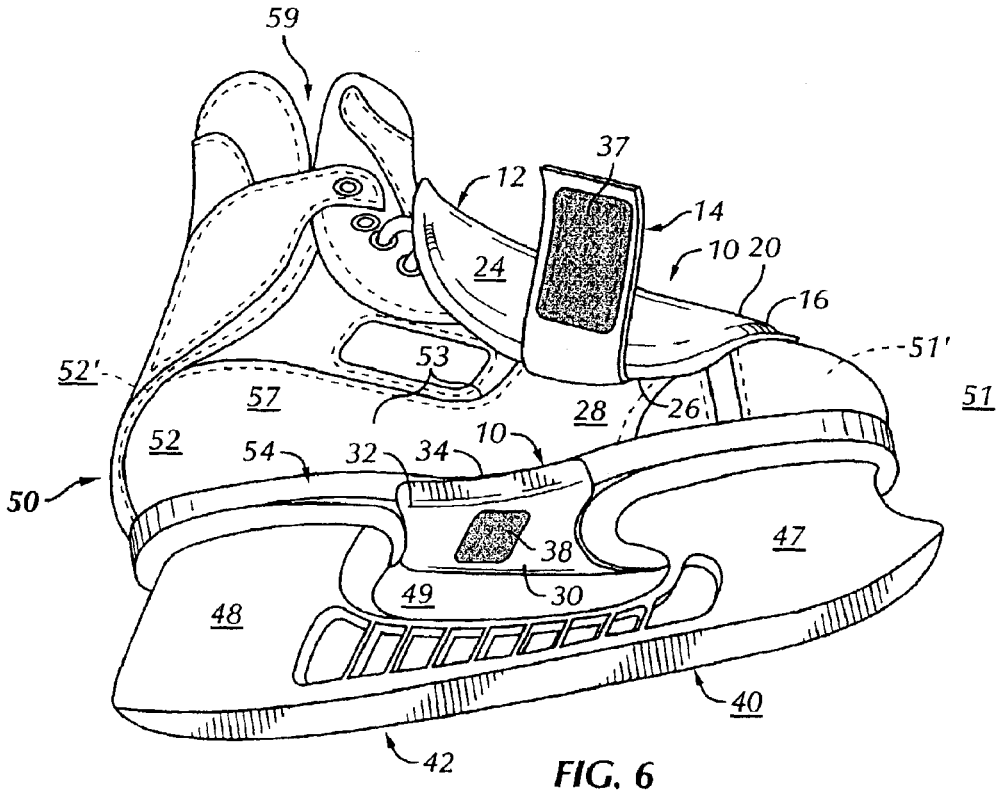
FIG. 6 is a lower view of the right side of the skate shield and skate of FIG. 5.

In shield 10, the tongue 30 preferably is also of a sufficient length with respect to the skate 40 to fully span the width of the sole plate 54 and is further provided with an upwardly extending hook portion 34 at its extreme free lateral end 32 to hook on the opposite (outer/lateral) side 58 of the sole plate 54 as well. This is shown in FIGS. 6–7. As can be seen in FIGS. 5–6, the intersection 23, tongue 30 and its hook portion 34, and flange 28 are preferably sized and shaped to essentially clip the shield 10 onto the sole plate 56 between the stanchions 47, 48.

The shell 12 is of a construction and material sufficiently rigid to provide a degree of protection to the wearer from the impact of an object that is typically encountered in ice hockey like a puck or stick striking the upper and/or medial sides of the skate covered by the shield 10 but with resiliency to absorb the impact itself and enough strength and resiliency to transfer the impact energy to one or more rigid area(s) of the skate 40, particularly, the sole plate 56 and/or reinforced toe 51' of the boot 50. Suggestedly the shell 12 is a made from a molded composite material such as a two part, hand laid, resin impregnated, graphite, glass, aramid or other engineered fiber but may also be injection or compression molded from an appropriate thermoplastic such as polypropylene, with or without fill (fiber reinforcement), depending upon the level of play of the user. Level of play may range from small children to adult professionals. Polypropylene, for example, makes for a strong, resiliently flexible, injection molded shell that can be spread open to slip over the top of the skate and still strongly contract to self-clamp to a skate as will be described.

Figure 2:
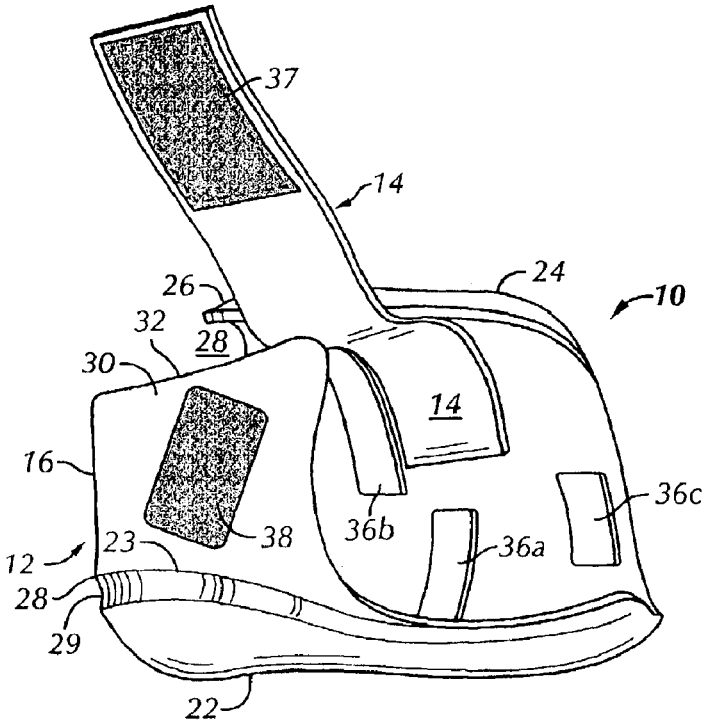
FIG. 2 is a view of the bottom of the skate shield of FIG. 1.
Figure 3:
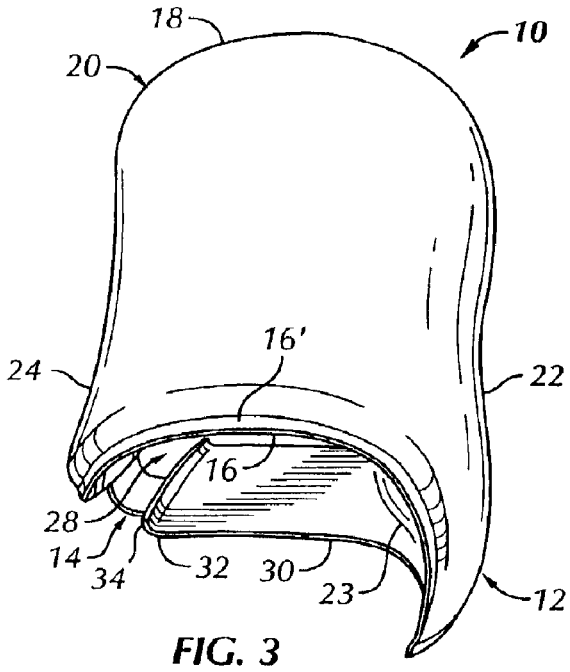
FIG. 3 is a front view of the skate shield of FIG. 1 in a closed configuration.
Figure 4:
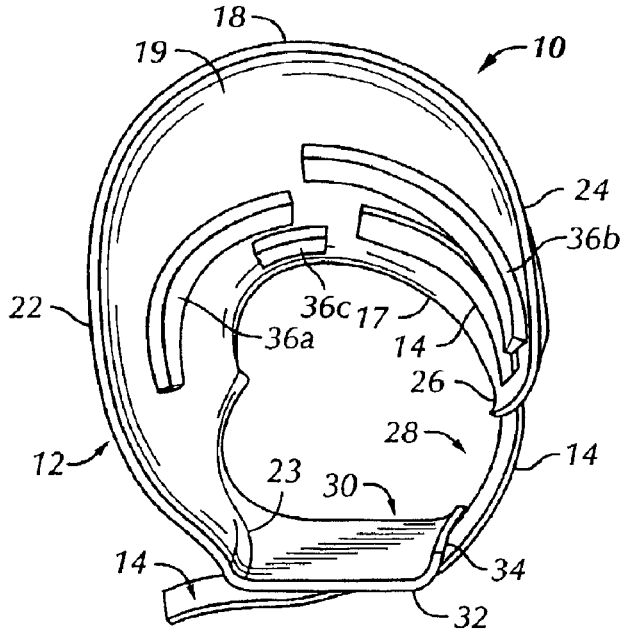
FIG. 4 is a view of the rear of the skate shield FIG. 3.

As is best seen in FIGS. 2–4, a resiliently compressible material, individual strips of which are indicated at 36*a*, 36*b* and 36*c*, may be provided on an inner side of at least the upper shell portion 20, positioned to contact an outer surface of the boot 50 and to space the upper shell portion 20 away from the outer surface of the boot 50. The resiliently compressible material may be a resilient yet flexible/compressible foam provided in several smaller strips or pieces as shown or in one or two larger strips/pieces. The material 36*a–c* is provided primarily to keep the device 10 in proper position with the upper shell portion 20 spaced from the flexible/softer portion(s) of the boot 50 and the tongue 30 releasably clipped to the bottom side of the sole plate 54. In this embodiment, the material 36 absorbs, at most, only a relatively minor portion the impact energy of an object striking the medial side of the shield 10 and helps to disperse that minor portion of impact energy not absorbed by the rigid portion(s) of the skate 40 over a larger area of the boot 50 than would have been contacted by the object directly striking the boot 50. In other embodiments, it may be necessary or desirable to use the resiliently compressible material to absorb and disperse more significant portions of impacts, especially if it is difficult to achieve a tight fit of the bottom of the device 10 on the sole plate 54 or otherwise fully or fixedly solidly mate the shield to rigid portion(s) of the skate 40. The resiliently compressible material is also used to disperse energy from impacts to the top of the shield, for example, from a hockey stick.

The strap 14 is flexible and is preferably fixedly secured at one end to the shell 12 with a free end 15 that can be releasably secured preferably to another part of the shell 12. In the depicted embodiment, the strap 14 carries on its inner side a length of fabric fastener loop material 37 forming a loop half of a flexible fabric hook and loop releasable closure. One or more mating hook fabric strip(s) 38 are preferably provided on the bottom side of tongue 30 to be releasably engaged by the strap 14 and thereby releasably secure the device 10 to the skate 40 and boot 50. The strapping prevents impacts from dislodging the tongue 30 from the sole plate 54.

It will be appreciated that to obtain the desired clip engagement of the shield 10 with the skate 40, the shell 12 will have to be designed for the sole plate 54 of each different skate of manufacturer and that several different shield sizes for each manufacturer may have to be provided to obtain the preferred clip engagement across the range of sizes of the manufacturer's skates. It will be further be appreciated that positioning means other than material 36A–36C might be employed to hold the shield in place in impact transmitting contact with the sole plate or other rigid element(s) or areas of the skate (such as skate portion 42 or the toe 51' or heel 52'). Such other means includes padding, a fluid or gel bladder or even direct fixed securement of the tongue to a rigid part of the skate portion 42 or the sole plate 54 or the reinforced toe 51' and/or heel 52' in the boot 50.

FIGS. 10–14 depict a second embodiment skate shield of the present invention indicated generally at 110. Skate shield 110 also comprises a protective shell indicated generally at 112 and strapping indicated generally at 114. Protective shell 112 is configured generally like shell 12 and includes an upper shell portion 120 that is curved in multiple directions into a general saddle shape so as to wrap laterally around the boot 50 of a skate 40 at least from the sole plate 54 on the inner/medial side 57 of the boot 50 over the boot and preferably to at least proximal the sole plate 54 on the opposing, outer/lateral side 58 of the boot 50. Shell 112 is preferably one integral molded piece that includes an upper shell portion indicated generally at 120 and a transverse tongue portion indicated generally at 130. Tongue 130 is joined with upper shell portion 120 along the bottom of the inner/medial side 122 of the upper side portion 120 along joint or intersection indicated generally at 123. The upper shell portion extends from the joint 123 over the top upper side 56 of the boot 50 to a free lateral end 126 on an outer/lateral side 124 of the shell 112. The tongue 130 extends away from the joint/intersection 123 to a free lateral end 132 proximal the free lateral end 126 of the upper shell portion. Again, a gap 127 is provided between the free lateral ends 126, 132. The strapping 114 of the shield 110 has two parts. Preferably, a flange 128 with adjoining shoulder 129 extends all around the periphery of the upper shell portion 120 except at the heel end 52 where the periphery is thickened for strength and rigidity. A first strap 180 has an end preferably unreleasably (permanently) secured to the tongue 130 and an opposing, free end 186 which is extended through a first ring 182 secured by the strap 183 to the upper shell portion 120 proximal its free lateral end 126. The free end 186 of the first strap 180 is then extended through a second ring 184, which is preferably secured to another strap 185 preferably having an end unreleasably secured to the medial side 122 of the upper shell portion proximal a rear/heel end 118 of that upper shell portion. After extending though the second ring 184, the free end 186 of the first strap is turned back against an intermediate portion of that strap 180 proximal the second ring 184 and releasably secured to that portion by means of a length of flexible fabric hook fasteners 188 secured to a side of the free end of the strap 186 facing the intermediate portion of the strap 180 and a length of flexible fabric loop fasteners 189 attached to the facing intermediate portion of strap 180. Many other strapping arrangements could be provided.

Skate shield 110 is again resiliently flexible, is configured along its lower medial side with a flange 128 to curve along and overlap the medial side of the sole plate 54 while the upper shell portion 120 is extended generally radially outwardly from the intersection 123 and flange 128 by shoulder 129 to extend around the boot 50 spaced generally away from the boot 50. The shell 112 is preferably provided along its toe (front) 116 and lateral (outer) 124 periphery with an inwardly extending shoulder 192 and contacting flange surface 194 which extends from a radially inward end of the shoulder in a direction generally parallel with the proximal surface of the boot 50 to contact the reinforced toe 51' as well as the softer outer (lateral) side 58 of the boot 50. The shell 112 is sufficiently resiliently flexible and sized sufficiently smaller than the skate 40 on which it is designed to be used so that, when mounted to the skate, the protective shell 112 essentially wraps around and self clamps to the skate 40, thereby holding the joint 123 in continuous, extended contact with the medial side of the sole plate 54 while the flange surface 194 at the toe end of the shell 112 wraps around and grips the reinforced toe 51' of the skate 40. In this way, the shell 112 releasably secures itself with the skate 40. The strapping 114 is provided to maintain the shell 112 in a proper position on the skate 40, especially during impact against the shell.

Figure 15:
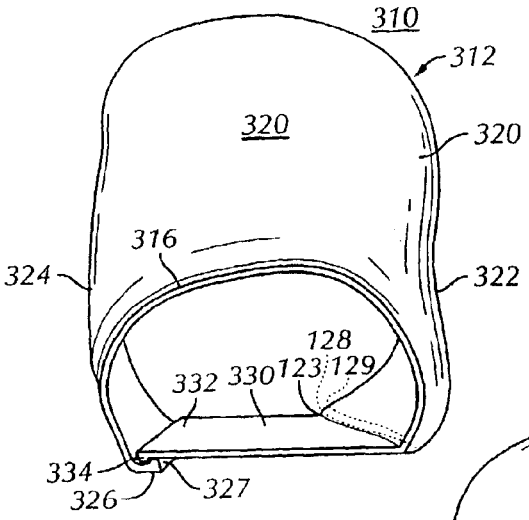
FIG. 15 is a front view of a third embodiment skate shield of the present invention before mounting to a skate.

FIG. 15 depicts a third embodiment of the skate shield of the present invention indicated generally at 310. Skate shield 310 again includes a shell indicated generally at 312 having an upper shell portion indicated generally at 320 and a tongue indicated generally at 330 extending transversally from a joint/intersection 123 with lower end of the upper shell portion 320 along the inner/medial side 322 of the shell 312 and shield 310. The tongue 330 has a free lateral end 332, which is preferably releasably secured with the free lateral end 326 of the upper shell portion 320 by means of a mechanical engagement such as a hook 327, which can be formed at the extreme free lateral end 326 of the upper shell portion and a mating hook 334 provided at the extreme free lateral end 332 of the tongue configured in such a way as to releasably secure together at or near the outer/lateral side of the sole plate 54. Again, the front/toe end 316 of the upper shell 320 is configured to contact, extend around and preferably self-clamp to the reinforced toe 51' of the skate to retain the shield 310 in position.

Figure 16:
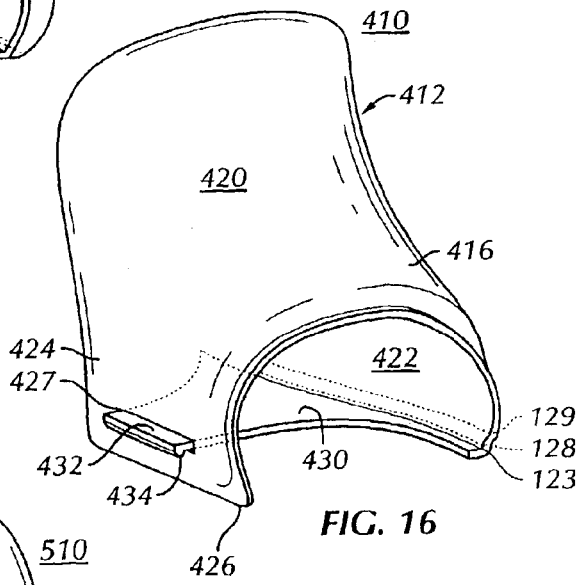
FIG. 16 is a front view of a fourth embodiment skate shield of the present invention.

The free lateral ends of the upper shell portion and tongue of skate shields of the present invention can be directly mechanically engaged together in different ways. For example, FIG. 16 depicts a fourth embodiment shield 410, which is identical to shield 310 of FIG. 15 except at the free lateral ends 426 and 432 of the upper shell portion 420 and tongue 430 of this embodiment. The free lateral end 426 of upper shell portion 420 is extended down past the sole plate 54 and, in place of hook 327, an opening 427 is provided through the upper shell portion 420 proximal the free lateral end 426. Another hook 434 or other male engagement structure on the free lateral end 432 of the tongue 430 is extended through the opening 427. If desired, this engagement could be reversed, for example by extending the free lateral end of the tongue sufficiently beyond the lateral side of the sole plate to provide an opening through the tongue which would receive a male engagement member extended integrally from the free lateral end 426 of the upper shell portion 420.

Figure 17:
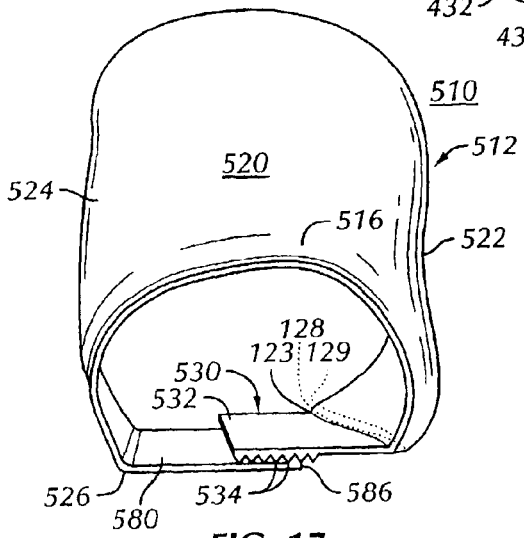
FIG. 17 is a front view of a fifth embodiment skate shield of the present invention.

Another variation of this mechanical engagement is depicted in FIG. 17 with a fifth embodiment skate shield 510 provided by a shell 512 having an upper shell portion 520 with a tongue 530. In this embodiment a second tongue 580 is extended transversely from the free lateral (outside) end 526 of the upper shell portion 520 to overlap and mechanically engage with the free lateral end 532 of the transverse tongue portion of 530 extending from the inner/medial end 57 of the upper shell portion 520. Simple mating hooks (like hooks 327, 334 of FIG. 15) can be provided at the free end of each tongue 530, 580, respectively. Alternatively, a series of hooks or serrations can be provided on one or both of the tongues 530, 580, like hooks or serrations 534 on tongue 530 with hook 586 on second tongue 580, to provide adjustable releasable securement between the ends of the tongues 530, 580. Again, in each embodiment, the toe end of the shield 10, 110, 310, 410, 510 is preferably configured to contact, extend around and self clamp to the reinforced toe 51' of the skate 40 as well as to contact and extend along the inner/medial side 57 of the sole plate 54 so as to transfer impact energy to the sole plate and to the reinforced toe 51'.

It will be appreciated that each of the foregoing embodiments of the present invention is releasably secured with an otherwise unmodified skate. By "releasably secured" it is meant that the skate shield may be mounted on and removed from the skate by the user manually, without tools and without any modification to the skate. The various embodiments discussed above employ different means of mechanical securement of the shield to a skate including strapping, self engagement between side edges of the shell, self clamping of the shell to the skate, particularly around the reinforced toe of the skate, and strapping. It will be appreciated that the skate shield might have any of a multiplicity of different physical forms to embody these different releasably securement means and further, that these different securement means may be used in different combinations from those specifically described above.

Figure 18:
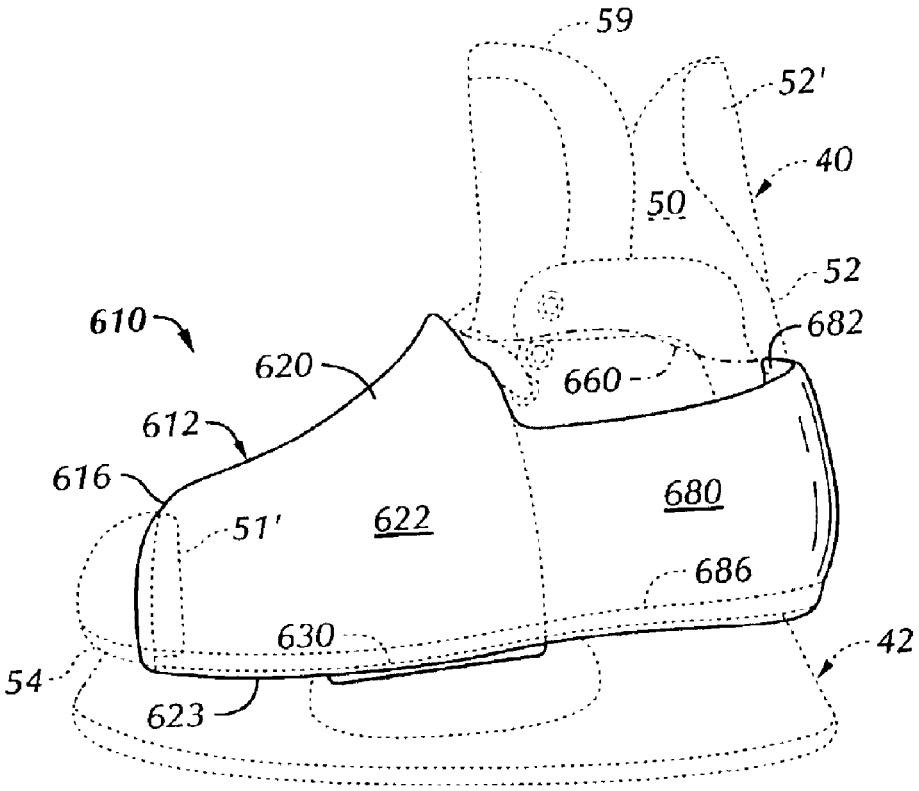
FIG. 18 is a medial side view of a sixth embodiment skate shield of the present invention.
Figure 19:
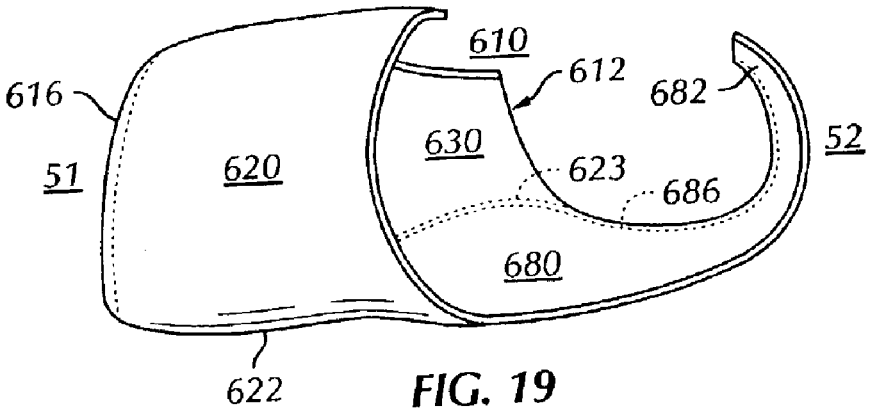
FIG. 19 is a top view of the skate shield of FIG. 18.
Figure 20A:
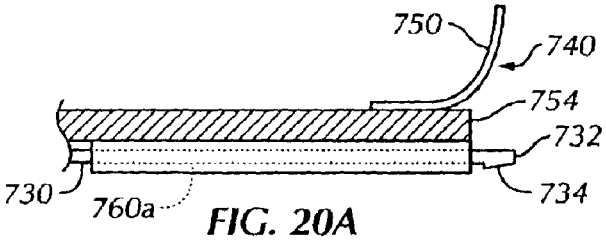
FIG. 20A is a close-up view of the mounting of FIG. 20 in the front-lateral side area.
Figure 20:
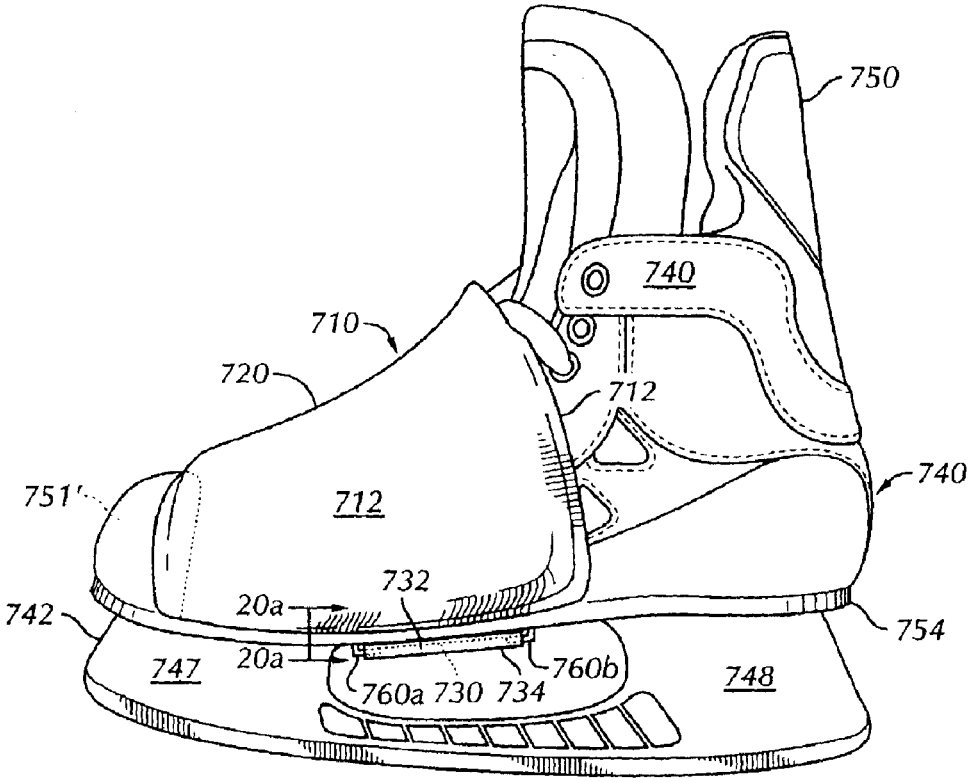
FIG. 20 is a lateral side view of seventh embodiment skate shield of the present invention mounted to a skate.

FIGS. 18 and 19 depict yet a sixth embodiment skate shield of the present invention indicated generally at 610. In this particular embodiment, the shield 610 is in the form of a shell 612 having an upper shell portion 620 joined at intersection 623 with a lower medial side 622 with a transverse tongue portion 630. However, the shell 612 further has a rear extension portion 680 which extends rearwardly from the medial side of the upper shell portion. The rear extension portion 680 extends around the boot 50 beneath the shaft opening 59 and hooks around the heel end 52 of the boot 50. Preferably, the front/toe end 616 is configured in the same way of the previous embodiments to contact, wrap around and self clamp to the reinforced toe 51' of the boot 50 (also phantom). The rear extension 680 extends to a free hooked end 682, which actually extends beyond the midline of the heel end 52 to the lateral side 58 of the boot 50 to releasably secure the shell 612 in position against the reinforced heel 52' (again phantom). Again, preferably, the lowermost end of the rear extension 680 is provided with a lower flange 686 (phantom) which is configured to extend along and contact the rear portion of the medial side edge of the sole plate 54 from the intersection 623, preferably around the heel end 52 of the boot 50. If desired, the rear extension 680 can also be raised as indicated by broken-dotted line 660 to cup upward and around the ankle area of the skater proximal the shank opening 59 at the top of the skate 40.

Where the skate can be manufactured or modified after manufacture to mount a shield, the shields of the present invention may take different forms. For example, FIG. 20 depicts a seventh embodiment skate shield of the present invention indicated generally at 710 mounted to modified skate 740. Skate 740 is identical to skate 40 but for the provision of a pair of preferably mirror image brackets 760A, 760B, which are fixedly secured with one or another of the sole plate 754 and stanchions 747, 748 and which are sized and shaped to slidingly receive the transverse tongue 730. The upper shell portion 720 is the same as previous upper shell portions. If desired, the lateral free end 732 of the tongue 730 can be provided with the downwardly transverse lip forming a hook 734 designed to catch on the open, lateral side ends of the brackets 760A, 760B (see FIG. 20A). Again, the cross sectional shape of the tongue 730 as well as the shape of the brackets 760A, 760B may take various forms beyond rectangular shape shown including but not limited to curved and wedged so long as the tongue effectively keys into and between the brackets 760A, 760B, to retain, preferably rigidly retain the tongue 730 beneath the sole plate 754 in much the same way that the original tongue 30 clipped to the sole plate 54. This embodiment would be releasably secured to the skate as the shield 710 should be able to be mounted and dismounted without tools.

Figure 21:
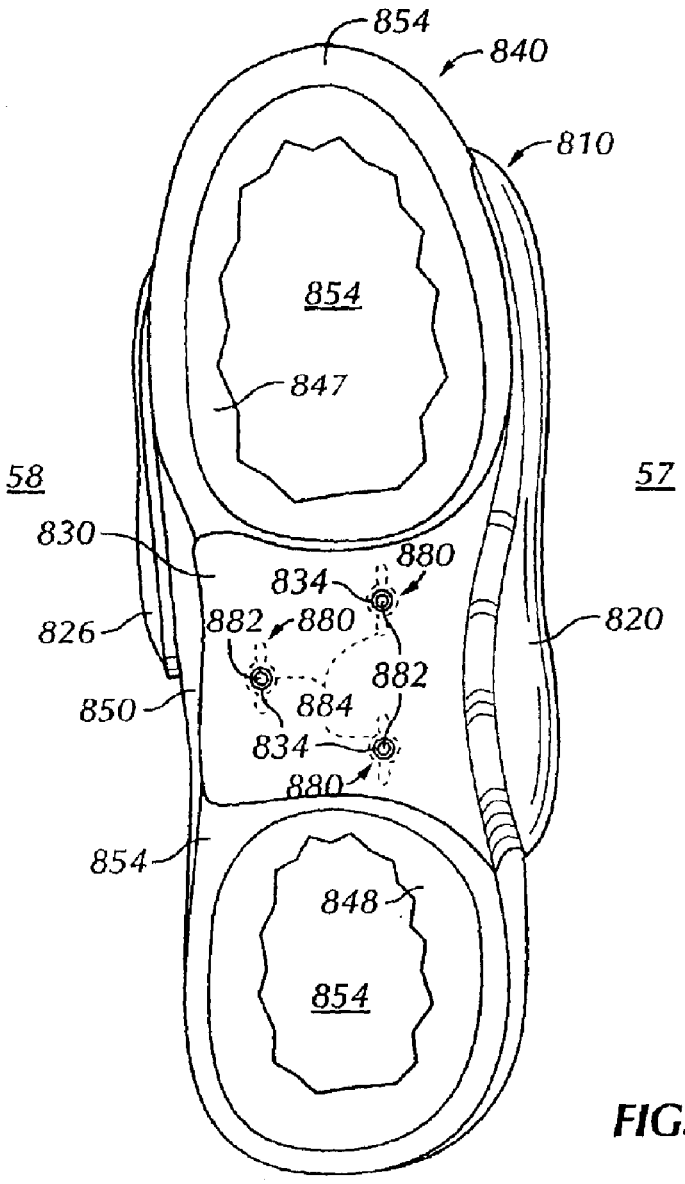
FIG. 21 is a bottom view of eighth embodiment skate shield of the present invention mounted to a skate.

FIG. 21 depicts an eighth embodiment skate shield indicated at 810 which is releasably secured or removably secured to the skate 840 through the use of fasteners indicated generally at 880 extended through the tongue 830 from the sole plate 854 and/or stanchion(s) 847, 848 (which are partially broken away in the figure). Fasteners 880 might be threaded shafts 882, which receive nuts (not shown) or thumbscrews 884 (phantom), or might be screws (also not shown) passed through bores 834 or other openings in the tongue 830 into threaded openings in or behind the stanchion(s) 847, 848 and/or sole plate 854. The thumbscrews 884 would provide releasable securement while the screws and nuts (not depicted) would require removable securement in that they would likely require the use of tools to properly work. The fastener(s) 880 need not be threaded. One or more posts, preferably with slightly enlarged distal ends, might be provided on the skate extending from the sole plate 854 and/or stanchion(s) 847, 848 to be received in suitable sized bores (e.g. 834) in the tongue or the tongue molded with one or more such posts along its upper/inner side to be releasably received in and secured with suitably shaped bores in the sole plate and/or stanchion(s). These various removably and/or releasably secured fasteners are collectively referred to as post and bore type fasteners. Again, these means of securement might be used by themselves or in combination with some of the other releasable securement means described in connection with the previous embodiments.

Figure 22:
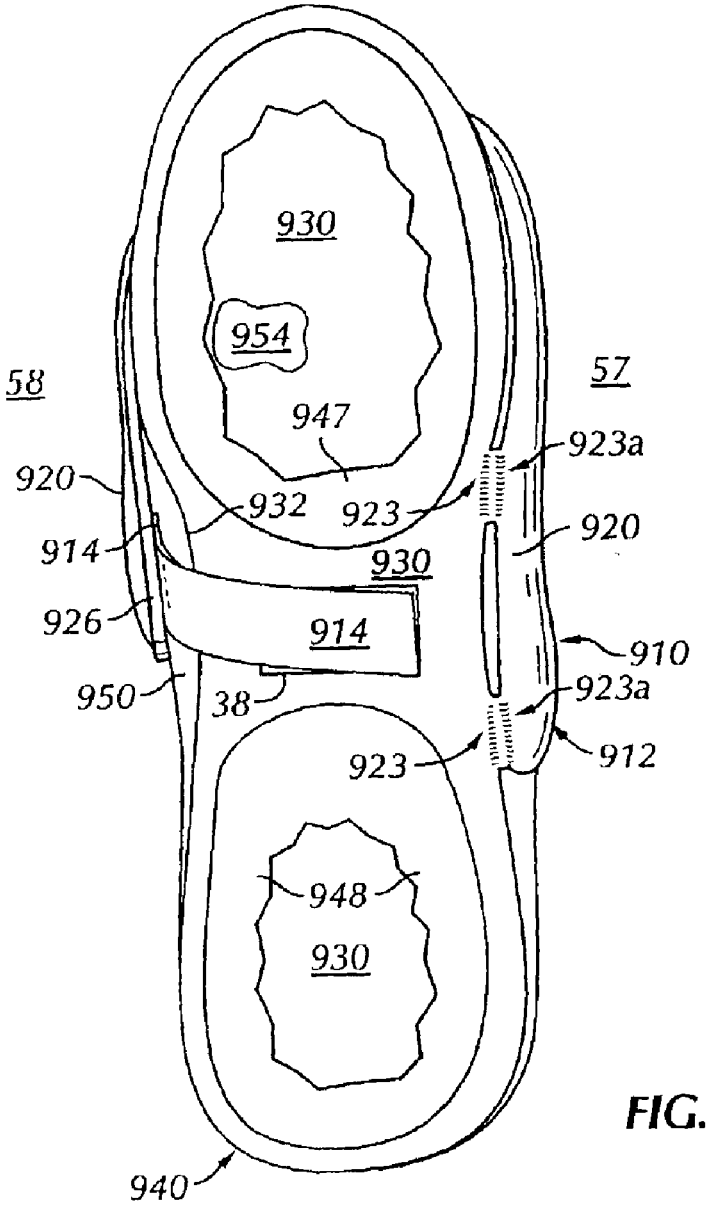
FIG. 22 is a bottom view of skate mounting a ninth embodiment shield of the present invention.

It is also possible to provide shields of the present invention as integral parts of the skates with which they are used. FIG. 22 depicts a ninth embodiment skate shield of the present invention indicated generally at 910 manufactured as part of a hockey ice skate 950. Shield 910 includes a shell 912 with an upper shell portion 920 and a transversely extending tongue portion 930. In this embodiment, the tongue 930 is enlarged and is mounted between the stanchion(s) 947, 948 and the sole plate 954 (seen in a breakaway in tongue 930 in stanchion 947). In this way, the tongue 930 is fixedly secured with between these rigid portions of the skate 940. The upper shell portion 920 extends upwardly from an intersection 923 with the tongue 930 up the medial side 57 and at least partially over the top side of the boot 950 and preferably over to the lateral/outer side 58 of the boot 950 to free, lateral end 926. If desired, the upper shell portion 920 can be coupled to the tongue 930 by means of a hinge 923A extending along the intersection 923. The free lateral end 926 of the upper shell portion 920 can be held in place by suitable means such as strapping 914 or releasable mechanical engagement (not depicted) with the lateral side 58 of the boot 950 or lateral free end 932 of the tongue 930. The upper shell portion 920 and tongue 930 can be made in one piece of the same molded polymer material with a living hinge 923A defining the intersection 923. If desired, the free lateral end 926 of the upper shell portion 920 can be releasably secured with the free lateral end 932 of the tongue 930 or another portion of the skate 940 on the lateral side 958 of the skate with any of the releasable securement means previously described. Finally, the "tongue" can be formed into a sole plate so that the shield is integrally and monolithically secured to the combination tongue/sole plate by a living hinge.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. In a skate having a toe end, a heel end and medial and lateral sides extending between the ends, the skate including a skate portion and a boot fixedly attached to the skate portion through a sole plate, the skate portion having a bottom side spaced from the sole plate and designed to contact a surface supporting the skate, the boot including at least a foot portion shaped generally to cover a person's foot between toe and heel ends and a shaft opening proximal the heel end to receive a skater's foot, a skate shield improvement comprising:

a protective shell mounted to the skate and including at least an upper shell portion extending upwardly at least past the medial side of the sole plate, up the medial side and over an upper side of the foot portion of the boot in front of the shaft opening and at least partially over a lateral side foot of the boot to a lateral free end of the upper shell portion, continuity of the protective shell being broken at the free lateral end, the protective shell being sufficiently resiliently flexible and being secured sufficiently solidly with one or more rigid portions of the skate on the medial side of the skate to transfer energy from impact against the medial side of the upper shell to the one or more rigid portions of the skate on the medial side of the skate and away from flexible portions of the boot covered by the protective shell.

2. The improvement of claim 1 wherein the protective shell is mated with at least the sole plate to transfer impact energy to the sole plate.

3. The improvement of claim 2 wherein the protective shell is secured against the medial side of the sole plate.

4. The improvement of claim 3 wherein the medial side of the protective shell is curved to essentially follow and mate with a curving contour along a medial side of the sole plate.

5. The improvement of claim 1 wherein the protective shell is unreleasably secured with the skate.

6. The improvement of claim 1 wherein the protective shell is unreleasably coupled with the sole plate.

7. The improvement of claim 6 wherein the protective shell is integrally formed with the sole plate.

8. The improvement of claim 7 further comprising a living hinge integrally coupling the protective shell with the skate portion.

9. The improvement of claim 1 wherein the protective shell is releasably secured to the skate.

10. The improvement of claim 9 further comprising flexible strapping secured with the protective shell and configured to releasably secure the shell with the skate.

11. The improvement of claim 10 wherein the protective shell includes a tongue extending transversally beneath the sole plate from a free end of the medial side of the upper shell towards the free end of the lateral side of the upper shell and wherein an end of the strapping is secured with the tongue to secure the shell with the skate.

12. The improvement of claim 11 wherein the strapping extends from the tongue and around the heel end of the boot.

13. The improvement of claim 9 wherein in the protective shell further comprises a tongue extending transversally beneath the sole plate from an intersection with the medial side of the upper shell towards the free end of the lateral side of the upper shell.

14. The improvement of claim 13 further comprising means for releasably securing the tongue with the skate.

15. The improvement of claim 13 wherein the tongue is configured to releasably clip to the sole plate.

16. The improvement of claim 9 wherein the protective shell extends sufficiently around the boot and sole plate and is sufficiently resiliently flexible and sized so as to self clamp onto and grip the skate and remain in position on the skate.

17. The improvement of claim 1 wherein the protective shell is asymmetrically shaped.

18. The improvement of claim 17 wherein the protective shell is asymmetrically secured with the skate.

19. The improvement of claim 1 wherein the protective shell is asymmetrically secured with the skate.

20. A shield for a skate having a skate portion and a boot mounted on the skate portion through a sole plate, the skate including a toe end, a heel end and medial and lateral sides, the sole plate facing and attached to a top side of the skate portion and supporting a foot portion of the boot shaped to cover a person's foot between the toe and heel ends, a space being provided between the skate portion and the sole plate, the shield comprising:

a protective shell including an upper shell portion and a tongue, the upper shell portion being generally curved so as to fit over the boot of the skate from proximal the toe end at least to an instep area of the boot and at least up past a medial side edge of the sole plate on the medial side of the skate to an opposing, lateral side of the skate, the tongue extending transversely from a bottom end of the medial side of the upper shell so as to extend beneath the sole plate sufficiently to hook the shield on the sole plate along the medial side of the sole plate, the shield further being asymmetric with continuity of the shield being broken between a free lateral end of the upper shell portion and a free lateral end of the tongue, the shell being sized and shaped to contact and extended along a medial side edge of the sole plate and the shell being of a construction sufficiently resiliently to deflect impact against the medial side of the shield at least to the medial side of the sole plate.

21. The shield of claim 20 further comprising securement means for keeping the shield in position on the skate in energy transferring contact with at least the medial side edge of the sole plate.

22. The shield of claim 21 wherein the securement means comprises:

a flexible strap member extendable at least from one of the tongue and the upper shell portion to a remaining one of the tongue and upper shell portion, the strap member being releasably securable to at least one of the tongue and upper shell portion so as to provide an opening between the lateral free ends of the upper shell portion and the tongue sufficient to permit the shell to be slipped over the boot portion of the skate.

23. The shield of claim 21 further comprising a resiliently compressible material on an inner side of at least the upper shell portion positioned to contact an outer surface of the upper of the boot and to space the upper shell portion away from an upper outer surface of the boot.

24. The shield of claim 20 further comprising a resiliently compressible material on an inner side of at least the upper shell portion positioned to contact an outer surface of the upper of the boot and to space the upper shell portion away from an upper outer surface of the boot.

25. The shield of claim 20 further comprising a resiliently compressible material on an inner side of at least the upper shell portion positioned to contact an outer surface of the upper of the boot and to maintain the tongue against a lower surface of the sole plate.

* * * * *